US007127842B2

(12) United States Patent
Murthy

(10) Patent No.: US 7,127,842 B2
(45) Date of Patent: Oct. 31, 2006

(54) THREE DIMENSIONAL MOBILE CONVERTED FROM TWO DIMENSIONAL OBJECT

(76) Inventor: Katyayini Murthy, 106 Haight Ave., Alameda, CA (US) 94501

( * ) Notice: Subject to any disclaimer, the term of this patent is extended or adjusted under 35 U.S.C. 154(b) by 333 days.

(21) Appl. No.: 10/712,233

(22) Filed: Nov. 12, 2003

(65) Prior Publication Data

US 2005/0097799 A1 May 12, 2005

(51) Int. Cl.
*G09F 1/00* (2006.01)

(52) U.S. Cl. ..... 40/124.08; 428/542.6; D11/141

(58) Field of Classification Search ..... 40/617, 40/124.08, 538, 539; 428/11, 12, 542.2, 428/542.8, 542.6; D11/157, 141
See application file for complete search history.

(56) References Cited

U.S. PATENT DOCUMENTS 2,395,578 A * 2/1946 Pergande ..... 40/124.09
3,849,234 A 11/1974 Pottkotter
4,156,975 A 6/1979 Harding
4,239,825 A 12/1980 Kaulfuss et al.
4,531,319 A 7/1985 Saxton
4,567,682 A 2/1986 Hurxthal
5,249,771 A 10/1993 Wear
D413,078 S 8/1999 Hanson
5,937,553 A 8/1999 Maran
6,139,168 A * 10/2000 Gary et al. ..... 362/252
6,363,637 B1 4/2002 Birmingham
D472,183 S * 3/2003 Flohe ..... D11/131
6,783,815 B1 * 8/2004 Flohe ..... 428/11

* cited by examiner

*Primary Examiner*—Gary C. Hoge
(74) *Attorney, Agent, or Firm*—Harris Zimmerman

(57) ABSTRACT

A three-dimensional mobile construction is fabricated as a two dimensional object and thereafter expanded into a three dimensional configuration suited for suspension as a mobile. Cut lines in a web defines elements linked in a contiguous arrangement, and the elements are moved out of the plane of the web to create the three dimensional display.

5 Claims, 12 Drawing Sheets
(4 of 12 Drawing Sheet(s) Filed in Color)

THREE DIMENSIONAL MOBILE CONVERTED FROM TWO DIMENSIONAL OBJECT

CROSS-REFERENCE TO RELATED APPLICATIONS

Not applicable

FEDERALLY SPONSORED RESEARCH

Not applicable.

SEQUENCE LISTING, ETC ON CD

Not applicable.

BACKGROUND OF THE INVENTION

1. Field of the Invention

This invention relates to mobiles that are typically used for esthetic enhancement of occupied spaces and, more particularly, to three dimensional mobiles that are fabricated as two dimensional objects and expanded to three dimensional form.

2. Description of Related Art

Mobiles are generally defined as abstract sculptures having moving parts that are driven either by motors or the natural force of air movement. The word mobile was initially suggested by Marcel Duchamp for a 1932 Paris exhibition of such works by the American artist Alexander Calder. One of Calder's first mobiles consisted of colored spheres motorized to move up and down curving wires at different speeds. Later, he developed wind mobiles from flat metal shapes suspended by wires from movable rods, which allowed for rotation. The revolving part s created a new visual experience of constantly changing volumes and forms; Calder, as he expressed it, was "making one or two objects at a time find actual relationship in space."

Following Calder's example, mobiles have become commonplace in modern decor for residential, business, and commercial uses. Mobiles are generally constructed of individual pieces or objects that are suspended from each other or from supporting struts or structures. Generally this construction technique involves some effort to balance the assembly so that it may be suspended from a single point and be susceptible to movement by air currents and the like. Thus the artisan must be skilled in selecting visually appealing combinations of elements, as well as balancing the weights of the elements to arrive at an assembly that is in equilibrium while permitting movement of the elements.

These factors tend to mitigate against mass production of mobile assemblies, due in part to the requirements of weight balancing. As a result, mobiles tend to be regarded as one-of-a-kind artistic creations, rather than commonly available decorative objects.

In the prior art, Design Pat. No. 413,078 appears to depict a kinetic sculpture which is formed from a three dimensional expansion of an object that may be collapsed into a flattened disposition. The object is a spiral suspended from its central point, and it is not apparent how the spiral is fabricated nor whether the flattened disposition involves a two-dimensional originating object.

BRIEF SUMMARY OF THE INVENTION

The present invention generally comprises a three-dimensional mobile construction that may be fabricated as a two dimensional object and thereafter expanded into a three dimensional configuration suited for suspension as a mobile. This fabrication technique enables manufacturing through a simple and inexpensive process, such as die cutting of a two dimensional web, and printing or color application may be applied in the same process. Thus the invention permits production of three dimensional mobiles at low cost. Furthermore, due to the fact that all the elements of the mobile are linked in some form of contiguous arrangement, a weight-balanced arrangement may be devised and then reproduced identically in large numbers without requiring balancing of each individual reproduction.

The technique described above may be applied to a variety of web materials, such as, but not limited to, sheet metal, thin wood on the order of veneer material, cardboard or card stock, plastic sheet that is transparent, translucent, or opaque, and the like. The only essential requirement for the web material is that it be sufficiently form-retaining to present a three dimensional appearance.

In one aspect, the invention provides a two dimensional web portion having a nominal axis of symmetry. A continuous spline portion of the web portion is defined, and a plurality of cut lines are formed in the web portion and are disposed to radiate from the spline portion without crossing it. As a result, the cut lines define fingers that are contiguous with the spline and radiate therefrom. The fingers may be expanded out of the plane of the web portion to create the three dimensional mobile presentation.

In one embodiment the spline extends along one edge of the web portion, and the fingers radiating from the spline are unattached at their outer ends. The spline portion may have a twist imparted thereto to cause the fingers to radiate at various angles about the axis of the spline.

In another embodiment of the invention, the spline extends through a medial portion of the web portion, and the cut lines are curved or angled to describe total included angles of approximately 180°. Thus the cut lines are nested curves defining fingers that have opposed ends joined to the spline portion, the fingers describing loops of varying size. The loops may be expanded out of the plane of the spline to define the three dimensional presentation of the mobile. In this embodiment, if the loops are defined by continuously curved cut lines the resulting loops are closed curves beginning and ending at the spline; if the loops are defined by linear portions of the cut lines joined by discrete angular excursions, the resulting loops are closed angular shapes beginning and ending at the spline. In either case the loops form interesting spatial arrays when deployed in three dimensions.

In a further embodiment of the invention, the web portion may be provided with a pair of opposed spline portions disposed at opposite edges of the web. A plurality of cut lines extend between the two splines to form fingers that are anchored at opposite ends to the opposed splines. The cut lines may be generally parallel and equally spaced, or may be arranged in other ordered layouts or randomly. A fold line may be placed medially in the web portion between the two splines, whereby the fingers are likewise folded in medial portions thereof. The entire assembly may be twisted so that the assembly when hung describes a curved, helicoidal shape.

In any of the embodiments described above, the web portion may be provided with decorative lines, images, characters, indicia, or the like to enhance the esthetic effect. The suspension point of any of the embodiments may be placed at one end of the spline portion thereof, or may be spaced apart from the spline portion to create an effect of asymmetry.

BRIEF DESCRIPTION OF THE DRAWING

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1A:
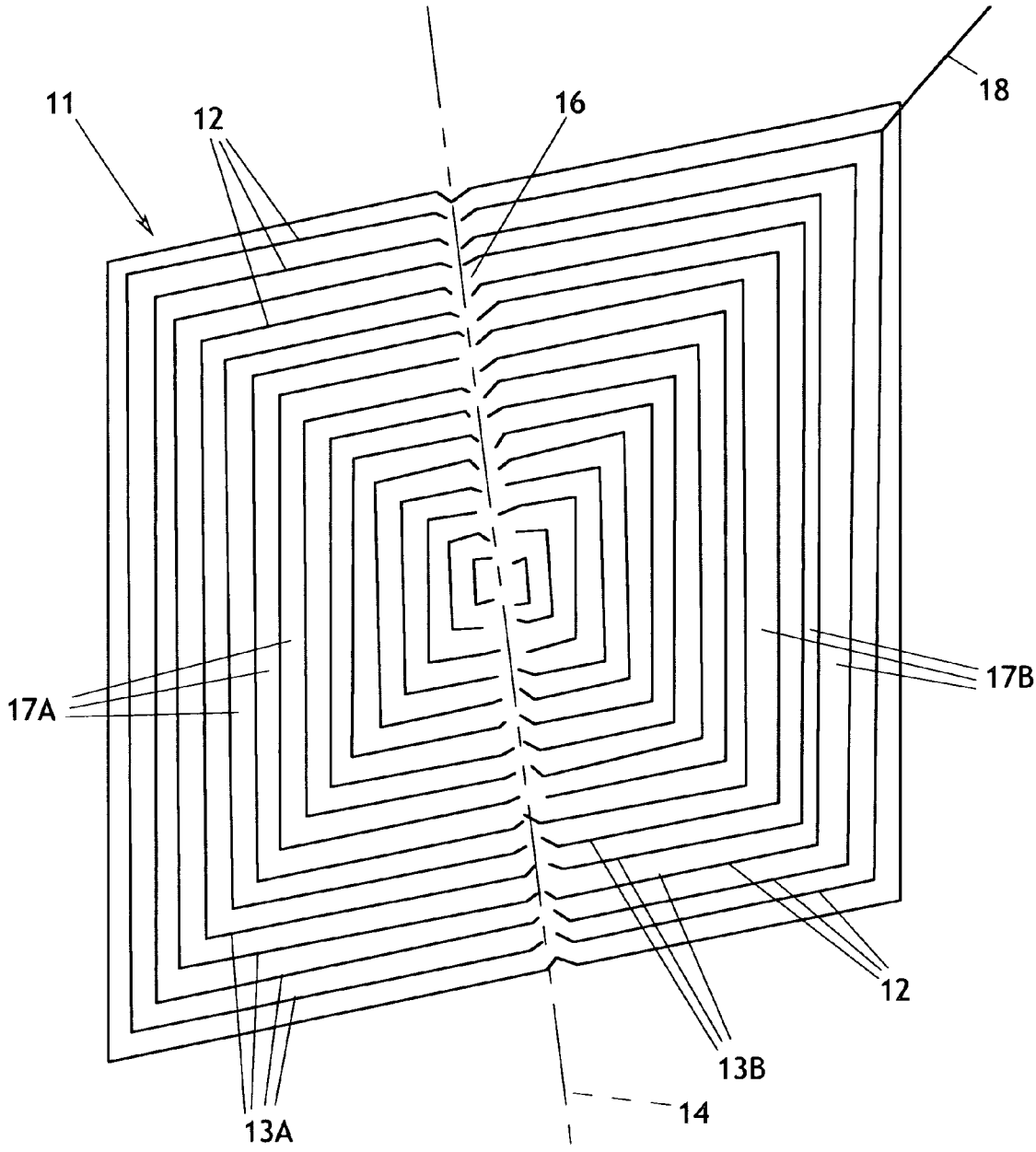
FIG. 1A is a plan layout of one embodiment of the mobile construction of the present invention.

The present invention generally comprises a three-dimensional mobile construction that may be fabricated as a two dimensional object and thereafter expanded into a three dimensional configuration suited for suspension as a mobile. In one example of the invention, shown in FIG. 1A, a two dimensional layout for a mobile includes a planar sheet or web portion 11 having four sides arranged in a rhomboid configuration, although the number of sides and the rhomboidal shape is not crucial for the design. A plurality of cut lines 12 are placed in the web portion 11, the cut lines being generally grouped as two pairs of arrays of nested curves 13A and 13B arranged generally in enantiomorphic relationship with respect to a nominal medial axis 14. It is noted that the paired nested curves do not join at the axis 14, so that a continuous medial spline portion 16 is defined in the web 11. The spline portion 16 is the primary structural component of the assembly.

Each array of nested curves 13A and 13B is comprised of linear portions of the cut lines joined in continuity by discrete angular excursions, the linear portions extending parallel to the related sides of the web portion and the angular excursions being substantially the same as the corner angles of the web portion. The concentric, nested arrangement of the cut lines defines a plurality of concentric loops 17A and 17B, respectively, have a total included angle of approximately 180°. The loops are closed angular shapes beginning and ending at the spline, to which they are integrally attached, which serves to support all the loops defined by the curves 13A and 13B.

Due to the fact that the spline portion 16 is relatively narrow with respect to its longitudinal extent along axis 14, it has little torsional beam stiffness and it is not difficult to rotate the loops 17A and 17B about the axis 14 and out of the two dimensional plane of the web portion 11. Indeed, the nested arrangement facilitates incremental rotation of adjacently nested loops merely by manually urging the larger loops to rotate with respect to the smaller loops about the axis 14, whereby the loops are angularly spaced to an extent that is visually harmonious. Thus the mobile is easily expanded from the two dimensional web fabrication stage to the three dimensional display configuration 19.

Figure 1B:
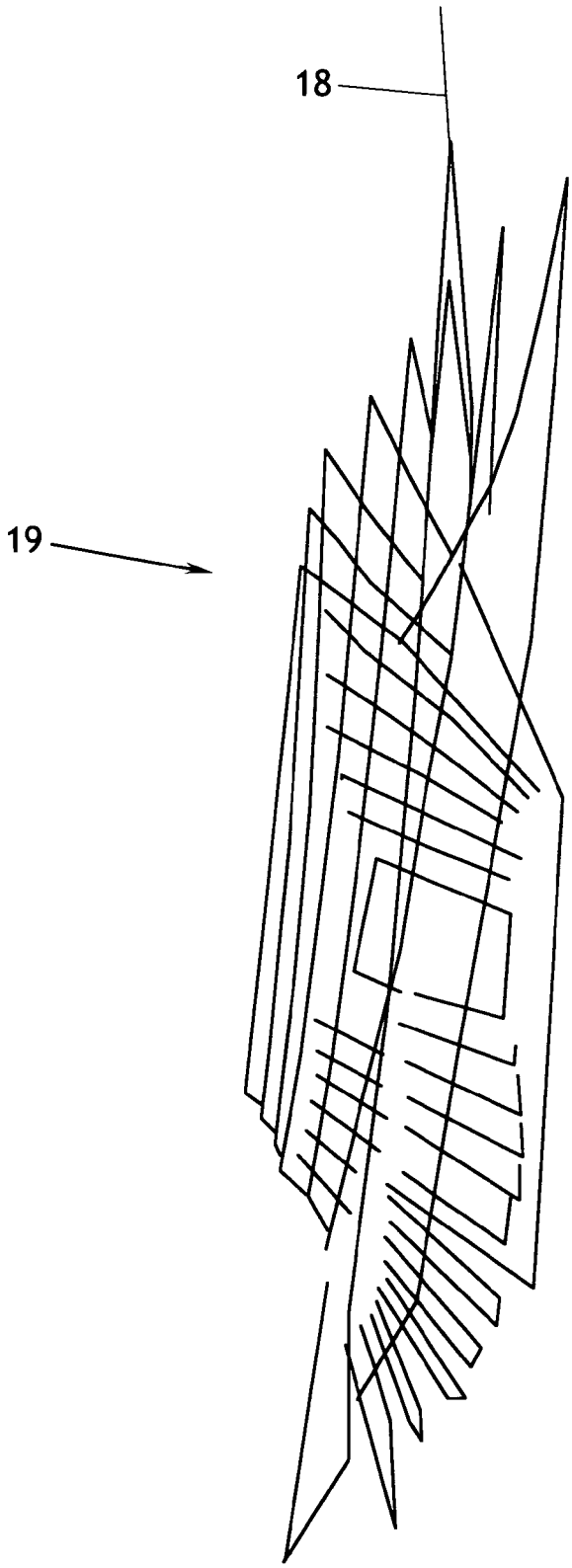
FIG. 1B is a perspective view of the mobile in its deployed, three dimensional state.
Figure 1C:
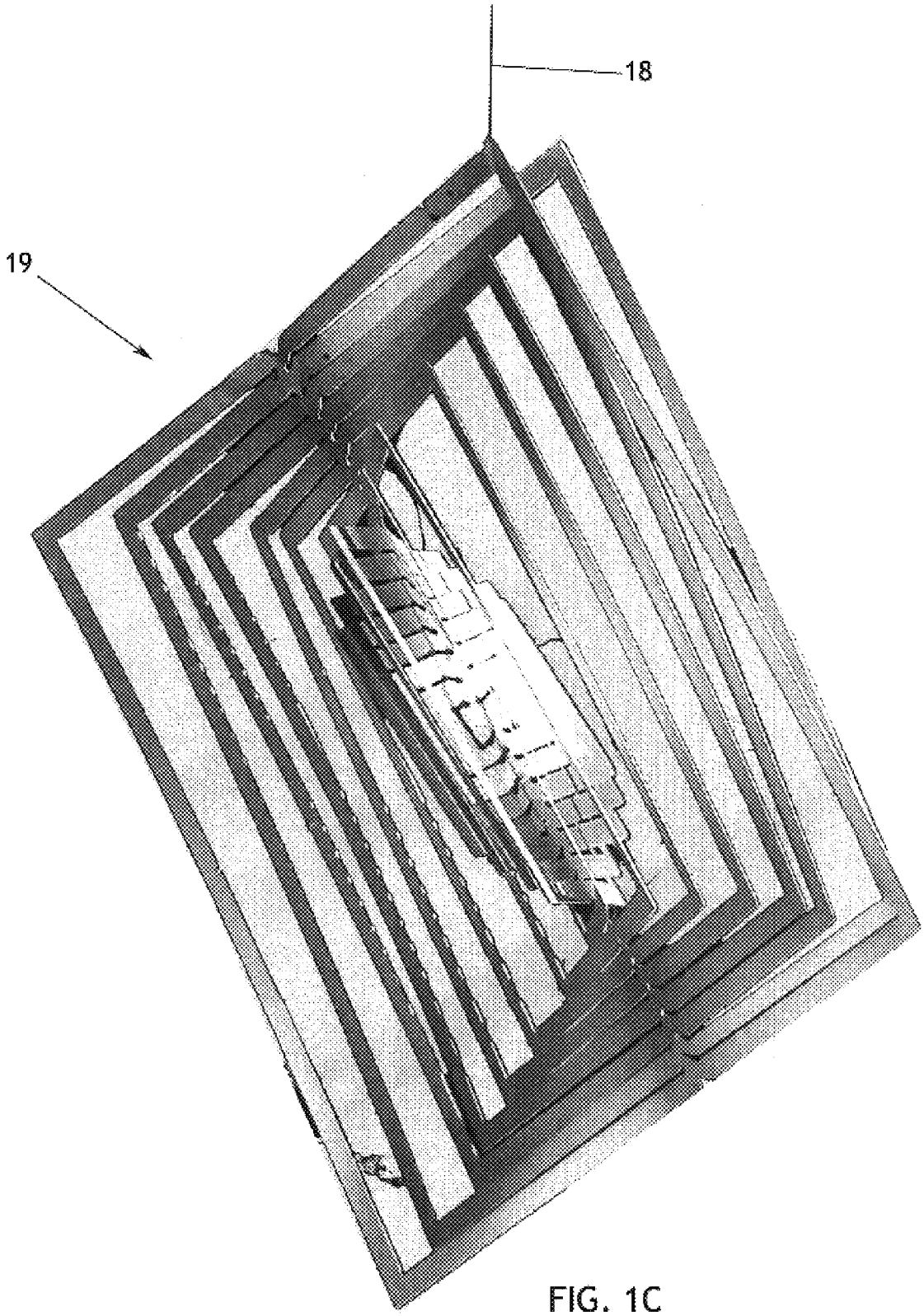
FIG. 1C is a photo of the mobile in its deployed state.

The mobile may be suspended by securing a suspension wire or line 18 to any convenient point at the outer periphery of the mobile. It may be suspended at a point along the spline portion 16. In the depiction of this embodiment, the mobile 19 is suspended from an acute corner of the outermost loop 17 to achieve the display effect depicted in FIGS. 1B and 1C. The material of the web portion 11 may be thin metal sheet, plastic sheet, paper or card stock, thin wood veneer stock, or the like.

Figure 2A:
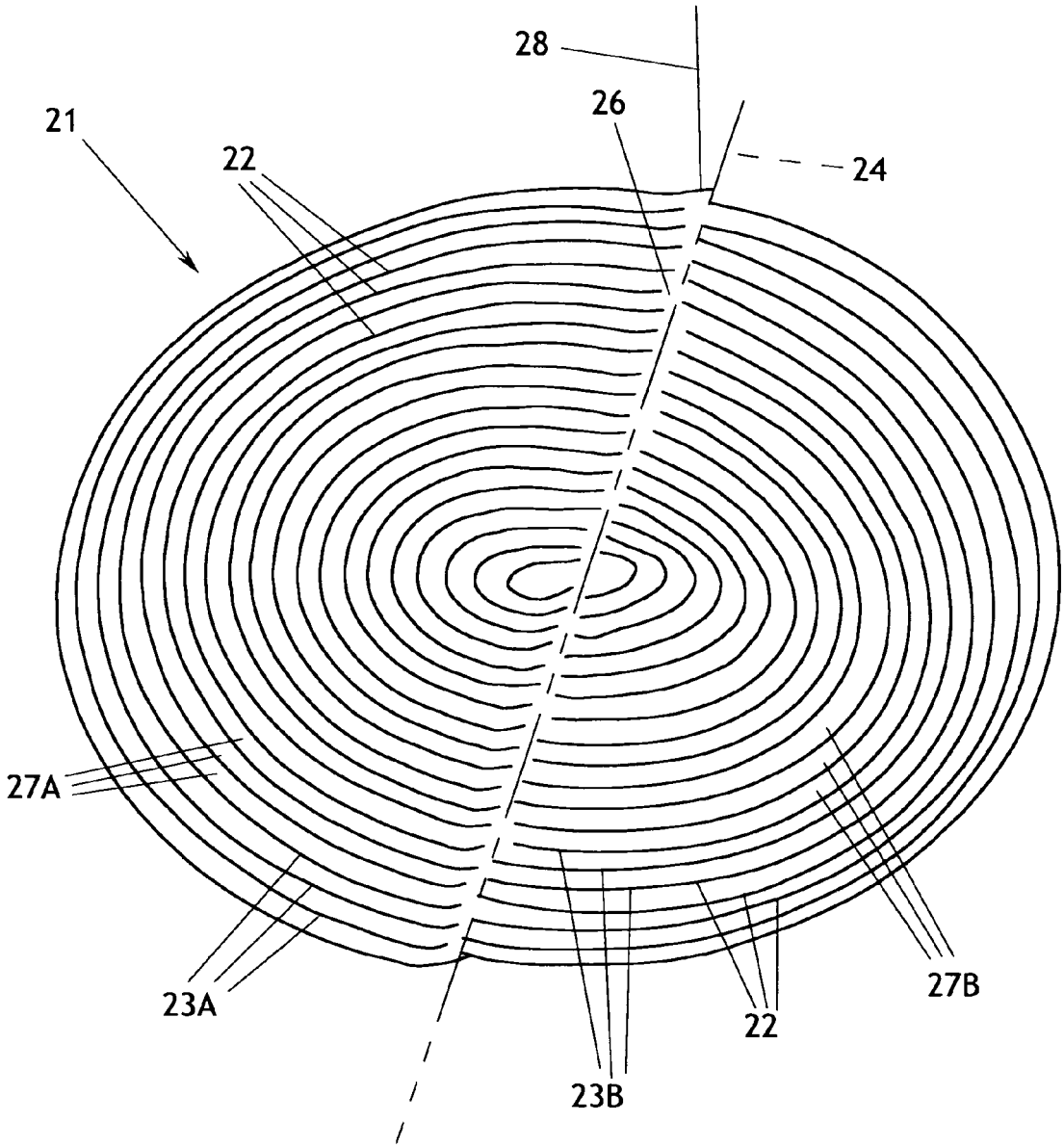
FIG. 2A is a plan layout of another embodiment of the mobile construction of the present invention.
Figure 2B:
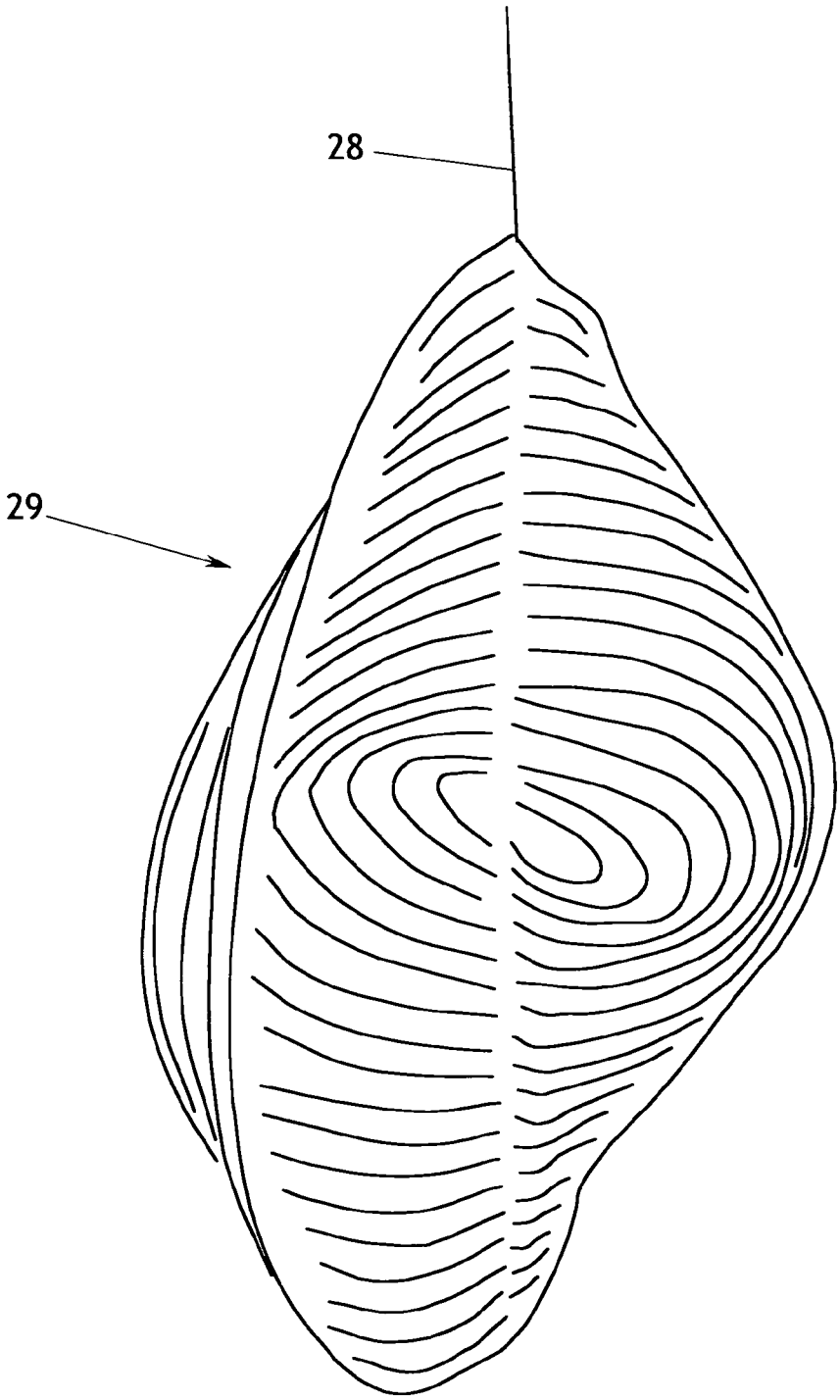
FIG. 2B is a perspective view of the mobile in its deployed, three dimensional state.
Figure 2C:
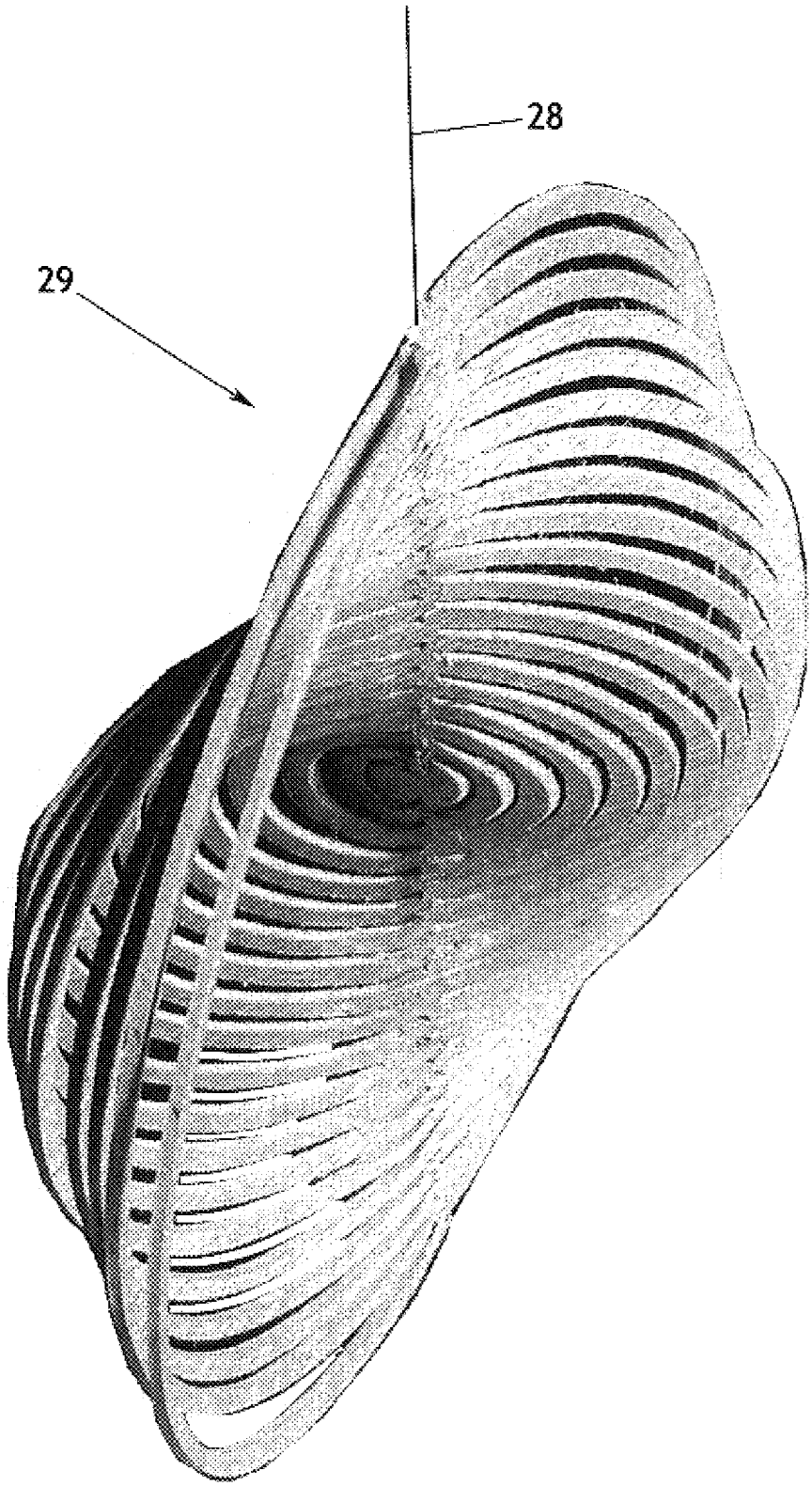
FIG. 2C is a photo of the mobile in its deployed state.

With regard to FIGS. 2A–2C, another embodiment of the invention includes a planar web portion 21 having a peripheral edge that describes a closed curve such as an oval, although the exact definition of the shape (ellipse, ellipsoid, egg-shaped, etc.) is not critical to the design. A plurality of cut lines 22 are placed in the web portion 21, the cut lines being generally grouped as two pairs of arrays of nested curves 23A and 23B arranged generally in enantiomorphic relationship with respect to a nominal medial axis 24. As in the previous embodiment, the paired nested curves do not join at the axis 24, so that a continuous medial spline portion 16 is defined in the web 21. The spline portion 26 is the primary structural component of the assembly.

Each array of nested curves 23A and 23B is comprised of continuously curved cut lines extending generally parallel to the adjacent outer peripheral edge of the web. The concentric, nested arrangement of the cut lines defines a plurality of concentric loops 27A and 27B, respectively, have a total included angle of approximately 180°. The loops are closed curved shapes beginning and ending at the spline, which serves to support all the loops defined by the curves 23A and 23B.

As before, the spline portion 26 is relatively narrow with respect to its longitudinal extent along axis 24, so that it has little torsional beam stiffness and it is easy to rotate the loops 27A and 27B about the axis 24 and out of the two dimensional plane of the web portion 21. Indeed, the nested arrangement facilitates incremental rotation of adjacently nested loops merely by applying differential manual pressure on the larger loops with respect to the smaller loops about the axis 24, to expand the loops three dimensionally to whatever extent desired by the user. Thus the mobile is easily converted from the two dimensional web fabrication stage (FIG. 2A) to the three dimensional display configuration 29 shown in the drawing of FIG. 2B and the photograph of FIG. 2C. In this embodiment the suspension line is preferably secured to the outer extent of the spline portion.

Figure 3A:
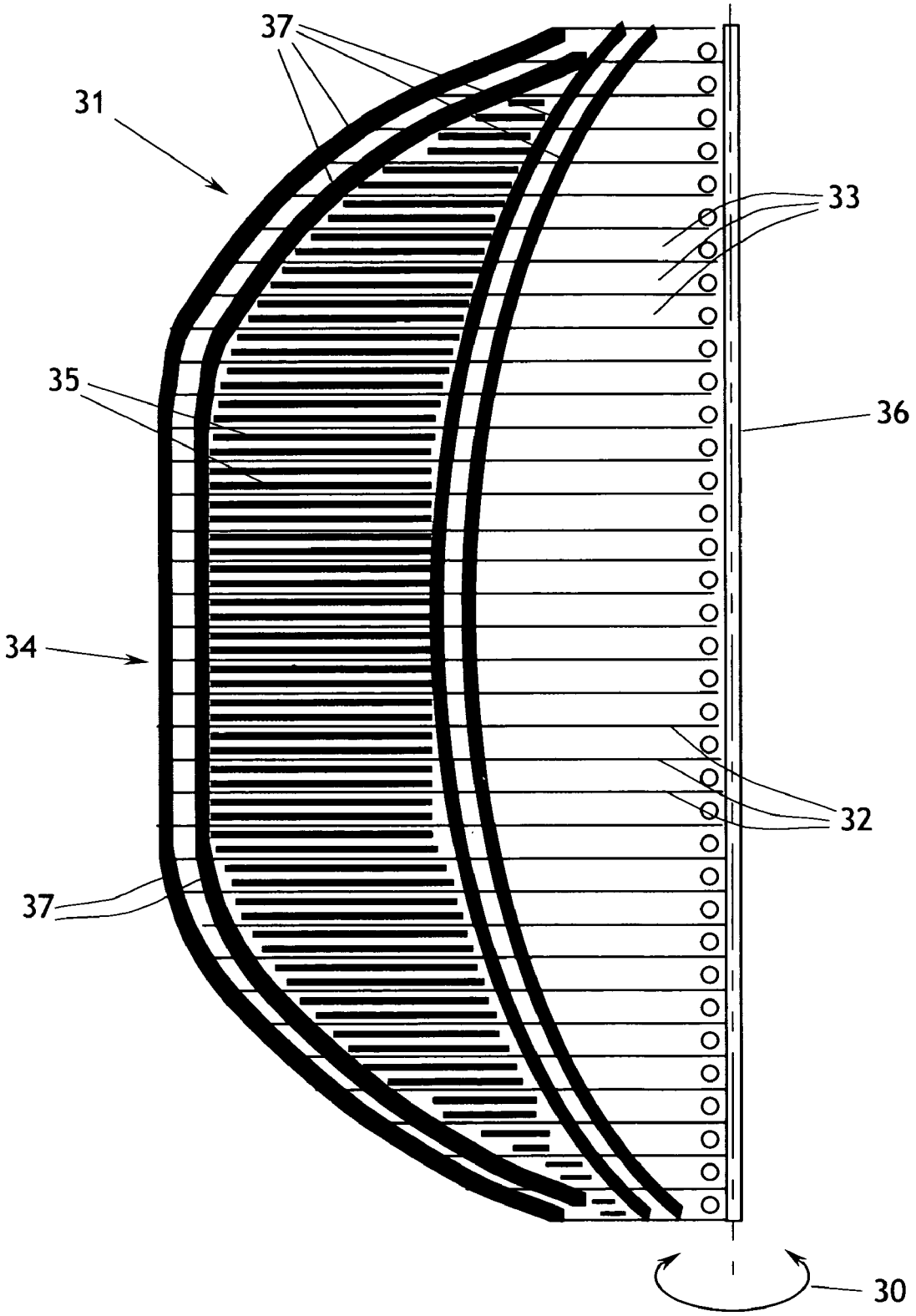
FIG. 3A is a plan layout of a further embodiment of the mobile construction of the present invention.
Figure 3B:
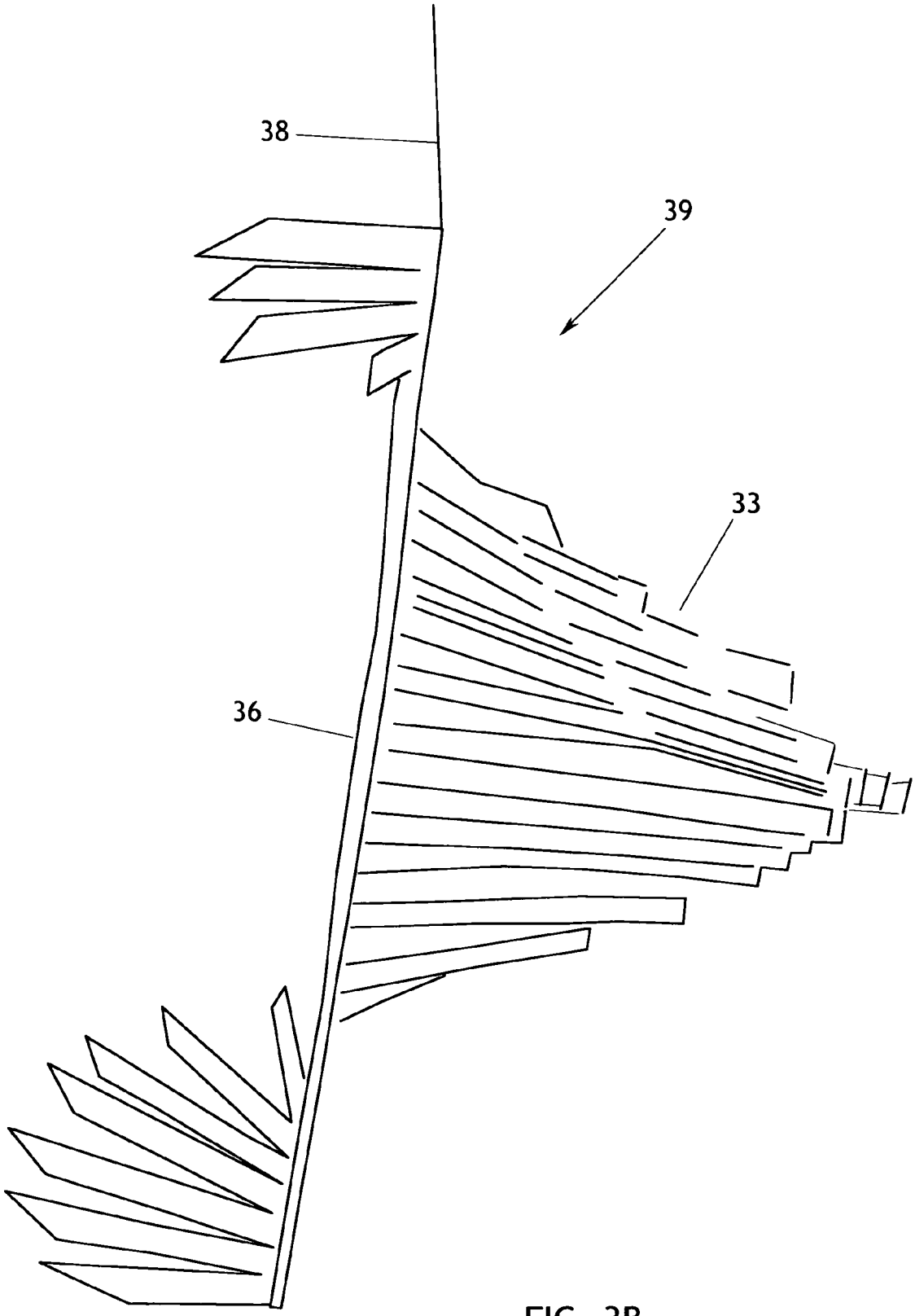
FIG. 3B is a perspective view of the mobile in its deployed, three dimensional state.
Figure 3C:
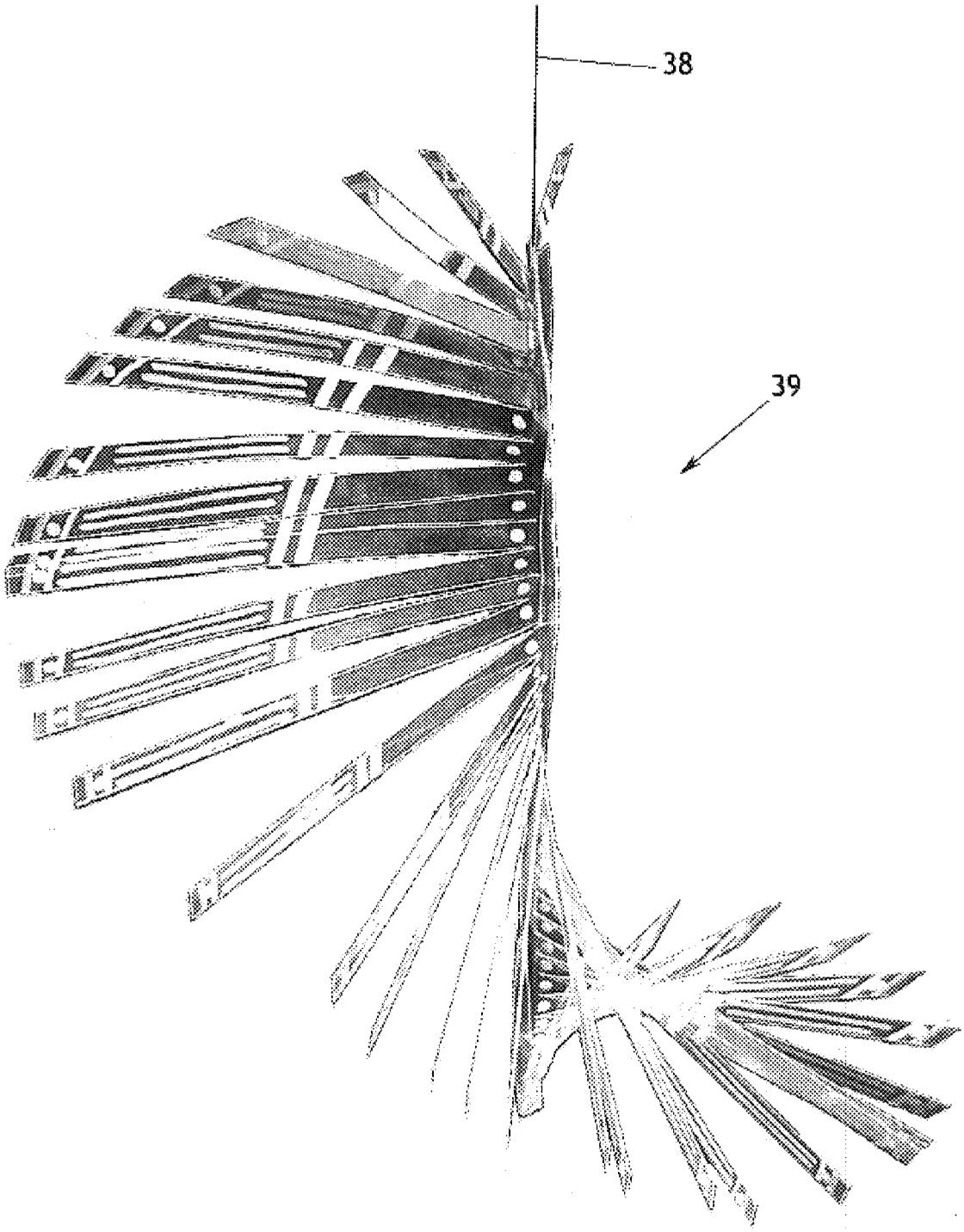
FIG. 3C is a photo of the mobile in its deployed state.

With regard to FIGS. 3A–3C, a further embodiment of the invention is formed from a planar web portion 31 that is generally comb-like in configuration, in that it includes a spline 36 extending along one edge thereof, and a plurality of cut lines 32 extending from the spline toward an outer edge 34 that is generally curvilinear. The cut lines define a plurality of parallel fingers 33 extending in parallel array from the spline 36. The fingers may be provided with a design treatment such as visually strong lines 37 extending parallel to the edge 34, finer lines 35 on each finger that are parallel to the cut lines 32, and the like. If the web portion is fabricated of clear plastic sheet material, the lines 35 accentuate the individual fingers 33, while the stronger lines 37 express a continuity between the separable finger ends.

The embodiment of FIG. 3A is suspended by a line 38 extending from one end of the spline 36, and the mobile is expanded into the three dimensional display configuration 39 by applying a twist to the spline 36, as shown by the rotation arrow 30, so that the fingers 33 are angularly separated. The continuity lines 37 emphasize the separation of the fingers 33, and the lines 35 add visual weight to the otherwise transparent fingers 33. As shown in FIGS. 3B and 3C, the resulting mobile is visually interesting, ephemeral, and graceful.

Figure 4A:
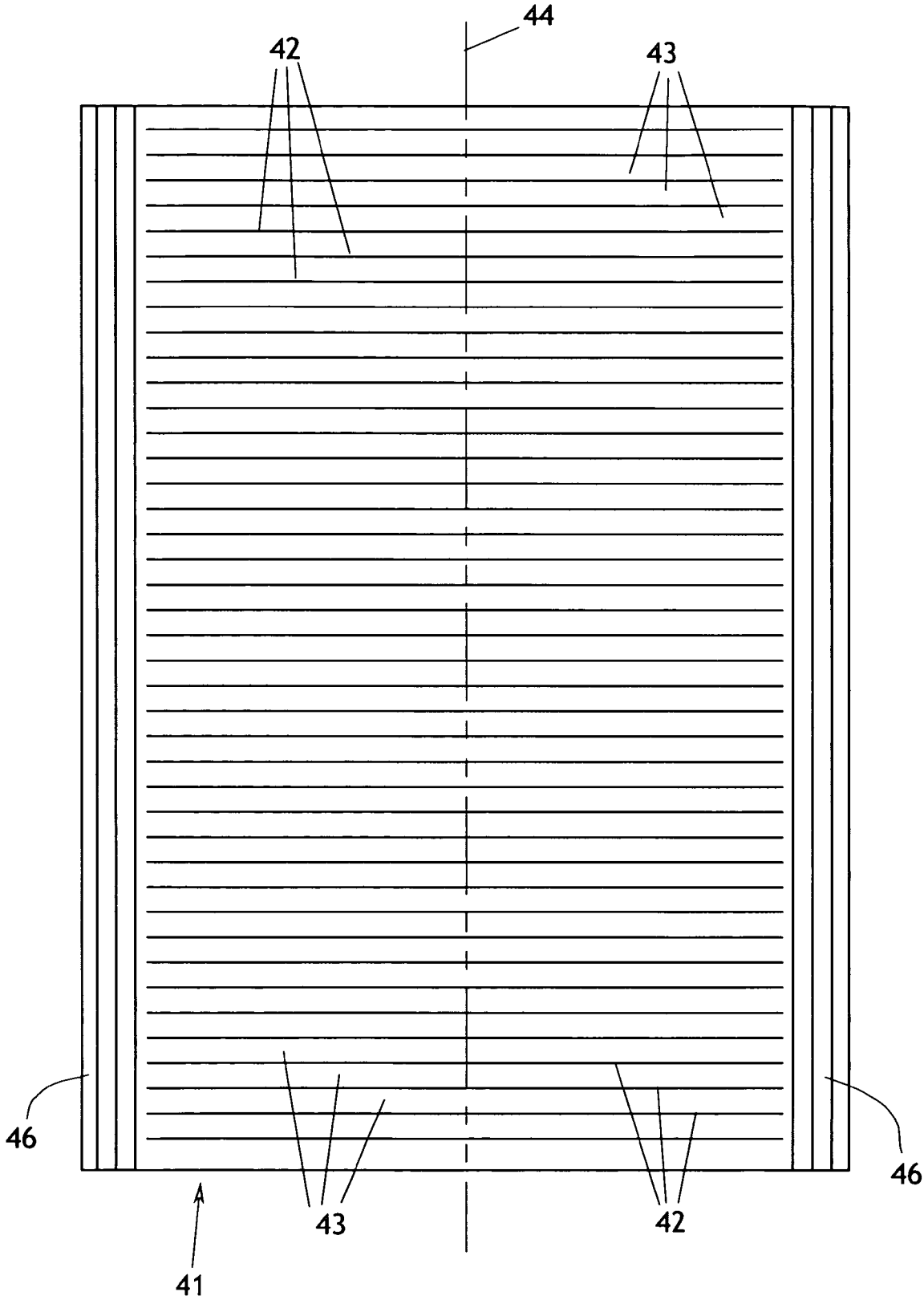
FIG. 4A is a plan layout of an additional embodiment of the mobile construction of the present invention.
Figure 4D:
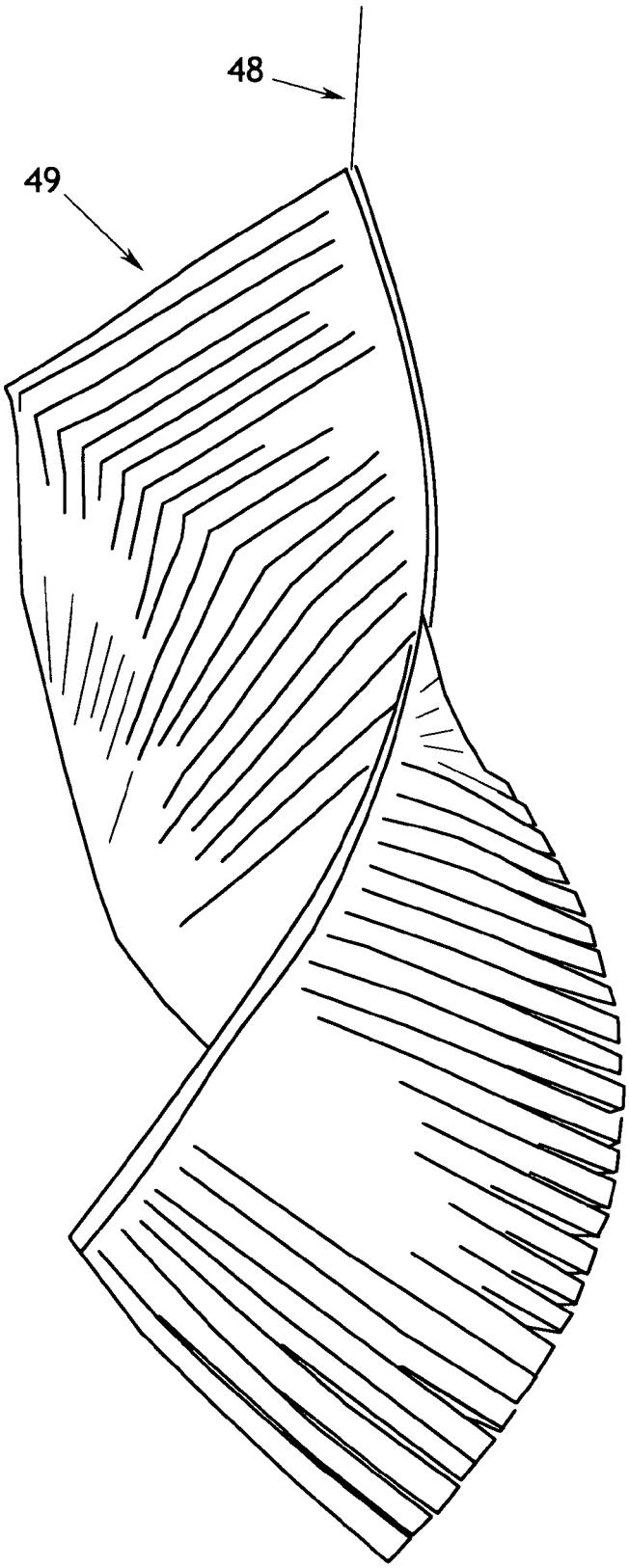
FIG. 4D is a perspective view of the mobile in its deployed, three dimensional state.
Figure 4B:
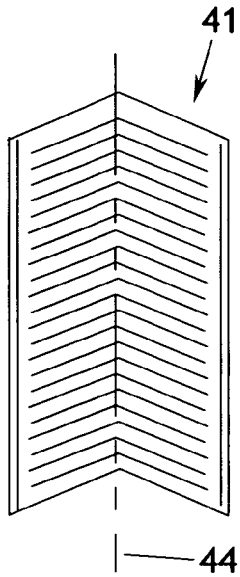
FIGS. 4B and 4C are plan views depicting the folding steps for forming the mobile.
Figure 4C:
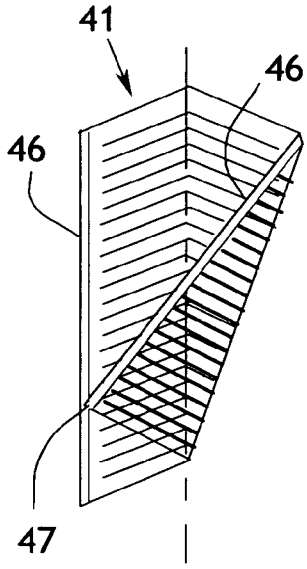

In a related embodiment, depicted in FIGS. 4A–4C, a web portion 41 is generally rectangular, with a pair of splines 46 extending along opposed side edges of the web portion. A plurality of cut lines 42 are arrayed in parallel, spaced apart arrangement, extending between and spanning the distance between the splines 46. The cut lines thus define a plurality of fingers 43 that are joined at opposed ends to the splines 46.

Figure 4E:
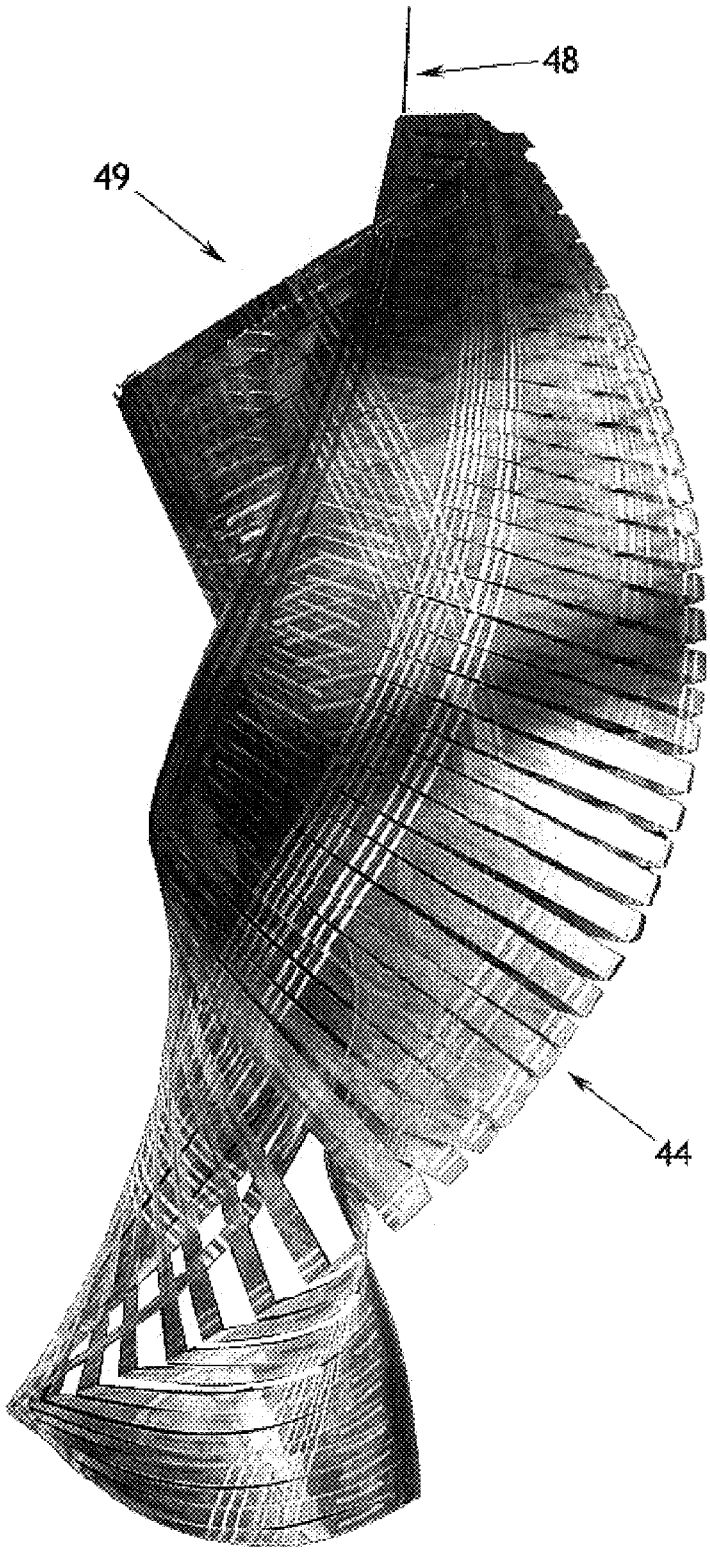
FIG. 4E is a photo of the mobile in its deployed state.

The simple layout of FIG. 4A may augmented by the addition of lines and other design treatment, similar to that provided in the embodiment of FIG. 3. In addition, as shown in FIG. 4B, the mobile is expanded from the two dimensional layout by first folding the web portion about a medial axis 44 that generally bisects the fingers 43, so that a crease is formed along the axis 44. The crease extends through all the fingers and establishes medial finger portions that are freed somewhat for curvilinear movement along the axis 44, as if they were free ends. Thereafter, the lower corner of one spline is folded over and joined to a lower medial portion of the opposed spline, as shown in FIG. 4C, to impart a further curvature to the web portion. The mobile may then be suspended by a line secured to the upper end of the same spline 46 which is folded over at its lower end. The result, as shown in the rendering of FIG. 4D and the photograph of FIG. 4E, is a curvilinear form that has an organic form and a fascinating appearance. In this embodiment, the web is formed of transparent plastic, although, as in the other embodiments, the selection of material and added design enhancements is the choice of the artisan.

The fabrication technique for mobiles described herein enables manufacturing through a simple and inexpensive process, such as die cutting of a two dimensional web, and printing or color application may be applied in the same process. Thus the invention permits production of three dimensional mobiles at low cost. Due to the fact that all the elements of the mobile are linked in some form of contiguous arrangement, various mobile suspension points may be used without jeopardizing the balance of the mobile. The mobiles may be reproduced identically in large numbers without requiring balancing of each individual reproduction.

It may be appreciated that the form factors presented in the various embodiments described herein are not crucial to the implementation of the invention. That is, features such as the outer perimeter configuration, the arrangement and placement of the cut lines on the web portion, the number and location of the splines, the use of folding and creasing of the web portion, the suspension point of the mobile, and the use and selection of color, line, image, indicia, and other artistic treatments of the web portion, may be selected by the individual who practices the invention without departing from the scope and teachings of this patent.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A decorative mobile construction, comprising:

a planar web having a defined perimeter configuration;

a spline portion extending along a medial portion of said web;

a plurality of generally parallel cut lines in said web radiating from said spline portion and defining separable strips that are integrally attached to said spline portion at the inner ends of said strips;

the inner ends of said strips on one side of said spline portion being linearly offset from the inner ends of said strips on the other side of said spline portion;

said strips being movable out of the plane of said planar web to form a three dimensional assembly; and means for suspending said assembly.

2. The decorative mobile construction of claim 1, wherein said cut lines are arrayed as a set of nested curves extending from said spline portion and defining a plurality of concentric loops integrally joined to said spline portion.

3. The decorative mobile construction of claim 2, wherein said nested curves extend generally parallel to said perimeter of said web.

4. The decorative mobile construction of claim 2, wherein said cut lines are arrayed as first and second sets of nested curves extending from said spline portion and defining first and second sets of concentric loops integrally joined to said spline portion and extending from each side of said spline portion.

5. The decorative mobile construction of claim 1, wherein said perimeter is an oval configuration.

* * * * *